United States Patent [19]

Maniero et al.

[11] Patent Number: 4,946,054

[45] Date of Patent: Aug. 7, 1990

[54] COVER FOR PACIFIERS

[75] Inventors: Daniel A. Maniero, Reedsburg, Wis.; Edward H. Meisner, Short Hills, N.J.

[73] Assignee: Gerber Products Company, Fremont, Mich.

[21] Appl. No.: 439,466

[22] Filed: Nov. 20, 1989

[51] Int. Cl.[5] ..... A61J 9/08; A61J 17/00

[52] U.S. Cl. ..... 215/11.6; 606/234

[58] Field of Search ..... 215/11.1, 11.6, 227; 220/287; 128/359, 360; 606/234–236 (U.S. only)

[56] References Cited

U.S. PATENT DOCUMENTS

| | | | |
|---|---|---|---|
| D. 243,366 | 2/1987 | Lybe et al. | 215/11.6 X |
| 1,191,516 | 7/1916 | Keil | 215/11.6 |
| 1,421,877 | 7/1922 | Weissheier | 215/11.6 |
| 1,425,532 | 8/1922 | Marr | 215/11.6 |
| 2,860,639 | 11/1958 | Hoover | 606/234 |
| 3,363,630 | 1/1968 | Hines | 606/234 |
| 4,192,307 | 3/1980 | Baer . | |
| 4,329,996 | 5/1982 | Copeland | 606/234 |
| 4,417,613 | 11/1983 | Ryan et al. | 215/11.6 |
| 4,493,324 | 1/1985 | Johnston | 606/236 |
| 4,819,641 | 4/1989 | Russell et al. | 606/234 |

FOREIGN PATENT DOCUMENTS

| | | | |
|---|---|---|---|
| 285737 | 10/1988 | European Pat. Off. | 128/360 |
| 552888 | 1/1923 | France | 128/360 |
| 1065055 | 5/1954 | France | 215/11.6 |
| 123221 | 2/1919 | United Kingdom | 128/360 |

OTHER PUBLICATIONS

Photograph of Gerber Products Company Soft Center Pacifier with Travel Cover, on sale in the United States for more than one year prior to this application.

Photographs of "Cherubs Collection" pacifier with Keep Klean cover, which may have been on sale in the United States since on or about Oct., 1988.

*Primary Examiner*—Sue A. Weaver

*Attorney, Agent, or Firm*—Price, Heneveld, Cooper, DeWitt & Litton

[57] ABSTRACT

A cover for a child's pacifier includes a top wall and walls depending therefrom which defines an enclosure for the pacifier and terminate in a common bottom edge. The bottom edge defines an opening to the enclosure allowing insertion of the pacifier and is contoured to fit closely around the periphery of the pacifier shield. At least one retaining flange is separated by spaced slots from the remainder of the depending walls and resiliently flexes outwardly to receive and retain one of variously sized pacifier shields. The flange includes a rounded detent which cams the flange outwardly for snap-in insertion of the shield. The detent holds the shield against supporting stops on the cover interior.

20 Claims, 2 Drawing Sheets

COVER FOR PACIFIERS

BACKGROUND OF THE INVENTION

This invention relates to sanitary covers for pacifiers and, more particularly, to a removable pacifier cover adapted for snap-in insertion of one of several types of children's pacifiers of the type including a mouth shield supporting and surrounding a nipple.

The provision of sanitary covers for children's pacifiers is widely known. Such covers are used by manufacturers to protect the nipple portion of the pacifier during handling and shipping before sale and by the parents of a child after sale on a repeatable basis to protect the pacifier during travel and before and after use by the child to prevent contamination, especially after sterilization. In the past, varying types of pacifier covers have been used. In one form, such as that shown in U.S. Pat. No. 2,860,639, a pacifier cover includes a conical section adapted to receive the nipple portion and an annular flange which is slit at spaced locations for fitting over and engagement with the periphery of a substantially rigid, apertured disk or mouth shield surrounding the nipple portion of the pacifier. The annular flange springs slightly outwardly in each of the sections between the slits to hold the disk in protective covering relation against spaced bosses provided within the shield.

The cover of U.S. Pat. No. 2,860,639 lacks any provision for positive retention of the pacifier disk within the cover and relies solely upon the spring action of the annular slit flanges extending around the cover. During rough handling such as when dropped by a child, the pacifier can easily dislodge from such a cover allowing contamination of the nipple portion.

Other varieties of pacifier covers have also been tried. For example, other covers adapted to be received over the mouth shields of pacifiers include inwardly extending projections on the cover interior. These projections are received over the peripheral edge of the pacifier shield to hold it securely in place within the cover. However, the terminal portions of the cover adjacent the opening in which the shield is received are relatively inflexible and thus must be fitted precisely to the size of the specific pacifier shield to be inserted and cannot accommodate various sizes of pacifier shields.

A need was therefore evident for an improved pacifier cover which would provide ease of insertion and yet secure retention of varying sizes of shields on pacifiers in order to reduce manufacturing costs by allowing the production of a single type pacifier cover for several different pacifiers. The present invention was devised in recognition of and as a solution for that need.

SUMMARY OF THE INVENTION

Accordingly, the present invention provides a removable cover for a child's pacifier which is adapted for easy snap-in mounting and retention yet secure protection for the pacifier. The cover is adapted for use with pacifiers of the type having a substantially rigid mouth shield surrounding and supporting a nipple mounted on and extending outwardly from the shield.

In one form, the removable cover includes a top wall and wall portions depending from the top wall defining an enclosure and having a bottom edge defining an opening to the enclosure for inserting a pacifier. Flange means are included on the depending walls for resiliently flexing and engaging the shield of the pacifier.

The flange means are separated from portions of the depending walls by space slots. A plurality of stop means on the interior of the depending walls are adapted to engage the pacifier shield. A pair of spaced detent means on the interior of the depending walls engage the pacifier shield and retain the shield against the stop means within the cover. At least one of the detent means is positioned on and movable with the flange means. When inserted in the cover, a periphery of the pacifier shield is engaged by the detents and retained firmly against the stop means while the flange means resiliently urge the shield against opposing portions of the depending walls.

In a preferred embodiment, the stop means are located at positions spaced from the detents and are spaced toward the top wall from the bottom edge on the interior of the cover. Preferably, two pair of stops are provided, one pair being spaced adjacent either side of the flange means, while the other pair of stops is spaced adjacent either side of the second detent.

In addition, a preferred embodiment includes a second flange separated from the depending walls by a pair of spaced slots, the second flange including the second of the pair of detents on its interior surface. In such form, the flanges are opposed to one another and securely retain the pacifier shield therebetween.

Preferably, the detents include curved surfaces for camming the flange outwardly and facilitating movement of the pacifier shield past the detents. Also, the cover preferably has the general shape of a truncated pyramid to provide sufficient room for insertion of the pacifier, the depending walls of the cover flaring outwardly and downwardly from the top wall such that the opening is larger than the top wall.

The pacifier cover of the present invention is easily fitted to varying sizes of pacifier shields because the flanges including the detents resiliently flex outwardly to accommodate such various sizes. Yet, the present cover allows ease of insertion of the pacifiers due to the camming surfaces provided on the detents which facilitate outward flexing of the flanges when the pacifier is inserted. In addition, retention of the pacifier, even those having shields with complex or compound curved peripheries, is positive and secure. Contamination due to dislodgement of the cover from the pacifier by rough handling by children is prevented.

These and other objects, advantages, purposes and features of the invention will become more apparent from a study of the following description taken in conjunction with the drawings.

DESCRIPTION OF THE PREFERRED EMBODIMENT

Figure 1:
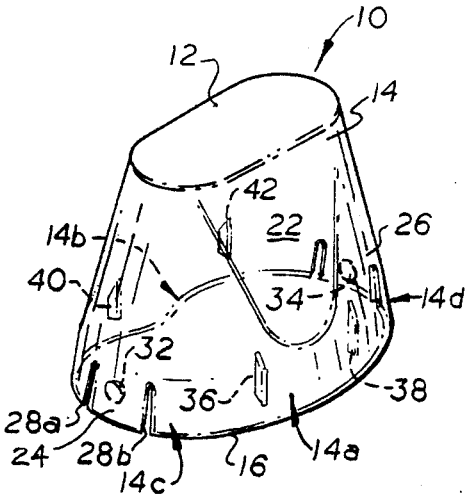
FIG. 1 is a perspective view of the pacifier cover of the present invention.
Figure 2:
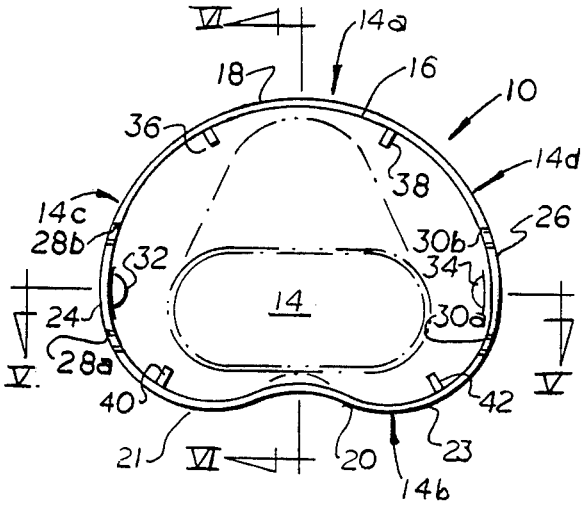
FIG. 2 is a bottom plan view of the pacifier cover shown in FIG. 1.
Figure 3:
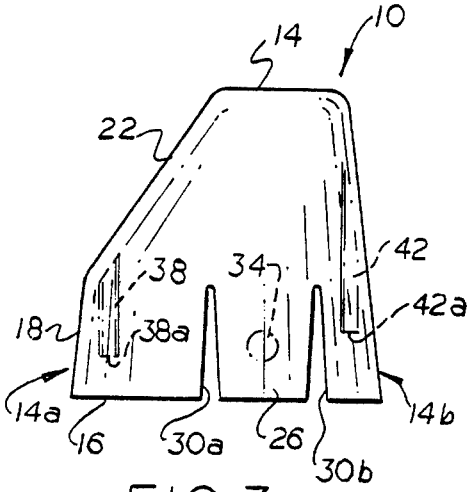
FIG. 3 is a right side elevation of the pacifier cover of FIGS. 1 and 2.
Figure 4:
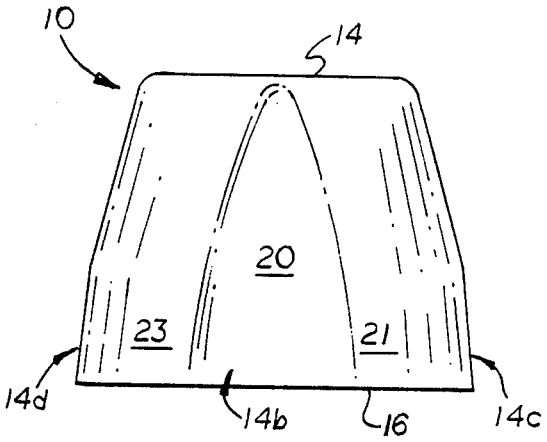
FIG. 4 is a rear elevation of the pacifier cover of FIGS. 1–3.
Figure 5:
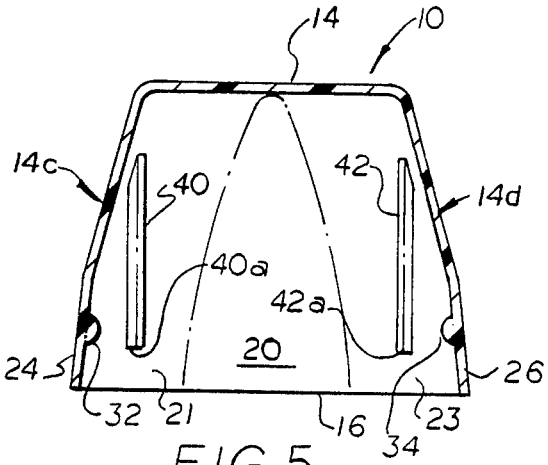
FIG. 5 is a sectional front elevation of the pacifier cover taken along plane V—V of FIG. 2.
Figure 6:
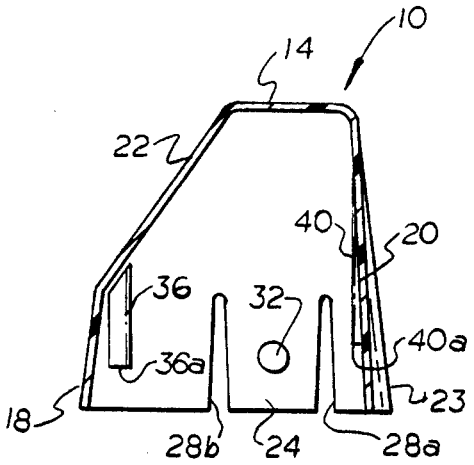
FIG. 6 is a sectional side elevation of the pacifier cover taken along plane VI—VI of FIG. 2.

Referring now to the drawings in greater detail, FIGS. 1–6 illustrate a preferred form 10 of the pacifier cover of the present invention. Preferably, cover 10 is molded in one piece from a transparent, resinous plastic material such as clear polycarbonate or the like. The cover includes a top wall 12 and continuous Walls or wall portions 20 14 depending from and joined integrally with the top wall. The depending wall portions include a front portion 14*a*, a rear portion 14*b*, and opposing side portions 14*c*, 14*d*. The depending wall portions 14 extend downwardly and outwardly in flared fashion to define an enclosure for surrounding the nipple of a pacifier when inserted in the cover and terminate in a common, continuous bottom edge 16. The shape of the bottom edge 16 is configured to generally parallel and surround the periphery of a configured pacifier shield of the type included on a conventional pacifier assembly such as that shown in FIGS. 7–9. As is best seen in FIG. 2, front wall portion 14*a* is rounded outwardly in convex fashion adjacent bottom edge 16 as shown at 18, while rear wall portion 14*b* is recessed in concave fashion as shown at 20. Sidewall portions 14*c*, 14*d* curve continuously from the rear to the front at opposite ends of the cover. The rear recess 20 tapers upwardly over the entire height of the back surface 14*b*, while convex portion 18 on the front of the cover extends partially up the height of the cover to a position where it joins a planar, inversely tapered front area 22 (FIGS. 1, 3 and 6).

Preferably, bottom edge 16 lies in a single, common plane as shown in FIGS. 3–6. Also, depending front and sidewall portions 14*a*, 14*c*, 14*d*, are flared outwardly at predetermined angles from top wall 14 to positions approximately two-thirds down the height of the cover where they meet more shallow inclined portions. Thus, upper portion 22 of front wall 14*a* is inclined at approximately 55° to top wall 14 while the lower portion 18 extends at approximately 83.5. to the top wall. Likewise, sidewall portions 14*c*, 14*d* have their upper portions adjacent top 20 wall 14 extending at approximately 75° to the top wall while the lower portions extend at approximately 83.5° to the top wall like convex front section 18. On rear wall portion 14*b*, the recessed portion 20 extends at approximately 85.5° to top wall 14 while the convexly curved areas 21, 23 extend at approximately 83.5° to the top wall like the lower portions of the front and sidewalls. These outwardly flared sections provide significant space within the cover for housing and protecting the nipple portion of the pacifier while surrounding the pacifier typically without contact with the nipple portion.

With reference to FIGS. 1–3 and 6, opposing sidewall portions 14*c*, 14*d* also include flanges 24, 26 which are opposed to one another across the cover 10. Flanges 24, 26 are formed at the lower edge of the cover by two spaced pairs of upwardly extending slots 28*a*, 28*b* and 30*a*, 30*b* which extend from the bottom edge 16 toward top wall 14. Flanges 24, 26 flex outwardly but are urged inwardly by their natural spring action to resiliently engage and hold the periphery of the shield on the pacifier when inserted within the cover as explained more fully below.

On each of the flanges 24, 26 is formed an inwardly protruding, spherically curved detent 32, 34 which engages under the peripheral edge of the pacifier shield after that shield is inserted The curved surfaces of detents 32, 34 provide camming surfaces which urge the flanges outwardly when the pacifier is inserted, but snap under the peripheral edge to help maintain a resilient holding action on the shield after insertion.

Positioned at spaced locations within the interior of cover 10 are four stop flanges or shoulders 36, 38, 40 and 42 (FIGS. 1–3, 5 and 6). Each of the stops is an elongated, rectilinear member which is preferably molded integrally with cover 10 in one piece. Alternately, stops 36, 38, 40, 42 may be formed separately and secured to the inside surface of the cover by a suitable adhesive Also, stops 36, 38, 40 and 42 are preferably of the same wall thickness as top wall 12 and depending walls 14 of the cover, namely, approximately 0.040 inch. The stops include bottom surfaces 36*a*, 38*a*, 40*a*, 42*a* which are parallel to the bottom edge 16 and are adapted to engage the upper surface of tho pacifier shield adjacent the periphery of the shield when inserted in the cover as explained below. The stops also help to strengthen and rigidify the depending walls because of their length along those walls. As shown in FIGS. 3, 5 and 6, because of the complex curve of the pacifier shield, stops 36, 38 on the inside surface of front wall 14*a* have their bottom surfaces 36*a*, 38*a* spaced closer to the bottom edge 16 than the top surface of detents 32, 34, while the bottom surfaces 40*a*, 42*a* of stops 40, 42 on the inside surface of rear wall 14*b* are at approximately the same level as the top surface of detents 32, 34.

Figure 7:
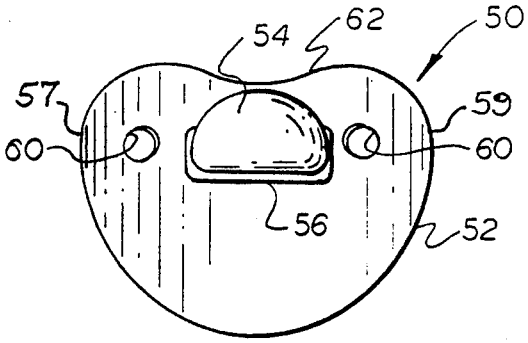
FIG. 7 is an end view of a conventional pacifier assembly with a mouth shield, the assembly being of the type adapted for coverage and protection by the present invention.
Figure 8:
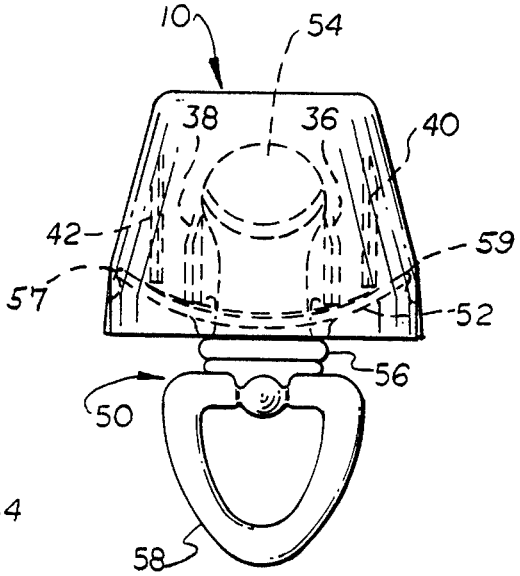
FIG. 8 is a front elevation of the pacifier cover of the present invention assembled with a pacifier with a shield of the type shown in FIG. 7 inserted within the cover.
Figure 9:
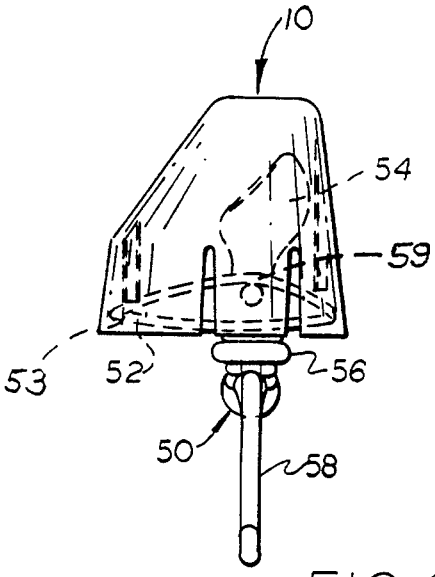
FIG. 9 is a right side elevation of the pacifier/cover assembly shown in FIG. 8.

Referring now to FIGS. 7–9, the preferred pacifier adapted for insertion within and protection by cover 10 is shown at 50. Pacifier 50 includes a substantially rigid, molded plastic mouth shield 52, and a rubber or other pliable, flexible hollow nipple 54 mounted on one surface of the shield 52 by means of a mounting support 56 which also pivotally secures handle 58 to the opposite side of shield 52. Shield 52 includes spaced breathing apertures 60 and a shield area having a convex curvature defined by a periphery having a compound curve best seen in FIGS. 8 and 9. The 20 shield is generally conve to fit the lip and external mouth area of the child to prevent the child from completely inserting the nipple and handle within his or her mouth. In addition, above the nipple area is a recess 62 adapted to fit under the nose of the child when the pacifier is in use.

To insert a pacifier 50 within cover 10, the pacifier is grasped by handle 58 adjacent mounting structure 56 and positioned with the larger curved portion 53 of shield 52 below nipple 54 in alignment with the convex curved portion 18 of the cover. The pacifier 50 is moved toward the cover such that nipple 54 is inserted within the interior of the cover through the opening defined by bottom edge 16 such that the depending wall portions 14*a*, 14*b*, 14*c* and 14*d* extend around and engage the complete periphery of the shield 52. Further insertion of pacifier 50 causes the surface of shield 52 on the nipple side of the pacifier at ends 57, 59 of the shield to engage the bottoms of spherically rounded detents 32, 34 on flexible flanges 24, 26. Pressure exerted on the pacifier toward cover 10 causes the shield 52 to urge the flexible flanges 24, 26 outwardly via the camming action of the curved detent surfaces. As the shield 52 passes the centers of spherical detents 32, 34, the spring-like resiliency of flanges 24, 26 returns the flanges toward the shield periphery such that the detents 32, 34 snap under the exterior surface of the shield as shown in FIG. 8. At the same time, the nipple side surface of shield 52 adjacent its periphery engages the bottom surfaces 36*a*, 38*a*, 40*a*, 42*a* of stops 36, 38, 40, 42 to stably support shield 52 at four spaced locations around the periphery of the cover (FIGS. 8 and 9). In such position, the resilient action of the flanges 24, 26 presses inwardly on the shield periphery to maintain the shield in contact with the bottom of the stops with detents 32, 34 preventing movement of the pacifier out of the cover. However, because of their resiliency, flanges 24, 26 can flex outwardly in varying degrees to accommodate shields which differ in size from one another thus allowing cover 10 to fit several different pacifiers. In the preferred embodiment, pacifiers with shields which differ in size, both larger and smaller within a range of about 3–10% can be reliably held by cover 10 in the above described manner. Since the wall portions of the cover closely surround and correspond to the peripheral shape of the shield 52, contaminants are prevented from moving past the shield to the interior of the cover thereby preserving the cleanliness of the nipple 54.

After insertion, it will be seen that the bottom surfaces 36*a*, 38*a*, 40*a*, 40*b* firmly contact spaced portions of the shield to prevent any rocking or pivotal motion of the shield within the cover. Likewise, because of such contact, the nipple 54 is supported in the interior space of the cover without touching the sides thereby further preserving cleanliness and/or sterilization.

For removal of the pacifier from the cover, the opposite action is required, namely, pulling the pacifier via handle 58 from cover 10 such that the bottom side surfaces of shield 52 which engage detents 32, 34 cam and urge the flexible flanges 24, 26 outwardly until the shield passes the center of the detents and is released from the cover.

The preferred polycarbonate material for the cover 10 has inherent resiliency and flexibility which is enhanced by the provision of resilient, flexible flanges 24, 26 for holding the pacifier in place when inserted. However, other resinous plastic materials may be substituted for the preferred polycarbonate material. In addition, while the preferred embodiment of the cover has been shown as being transparent, it will be understood that other resinous plastic materials which are translucent or opaque may also be utilized. Also, while the preferred embodiment utilizes an opposed pair of flexible flanges 24, 26, the principles of the invention may also be accomplished by providing one flexible flange on which one of the detents 32, 34 would be mounted. In such form, the single flexible flange is positioned opposite to the location of the remaining detent. Further, the position of the flexible flange or flanges around the bottom periphery of the cover could be modified without altering the function of the cover. Moreover, the flexible flange could be incorporated in a position above the bottom edge without necessarily requiring one edge of the flange to be a free edge.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A removable cover for snap-in insertion, retention and protection of pacifiers of the type having a mouth shield and a nipple mounted on and extending outwardly from the shield, said cover comprising:

a top wall;

walls depending from said top wall defining an enclosure and having an interior surface, said depending walls terminating in a common bottom edge defining an opening to said enclosure opposite to said top wall, said opening adapted to generally outline the periphery of the pacifier shield when received therein;

at least one pair of spaced slots in said depending walls, said slots extending toward said top wall from said bottom edge and defining a flange terminating at said bottom edge which can resiliently flex outwardly when the pacifier shield is received therein, said flange having an interior surface including a first detent thereon which is spaced toward said top wall from said bottom edge;

said depending walls further including a plurality of stops on said interior surface spaced toward said top wall from said bottom edge for supporting the pacifier shield and a second detent positioned on said interior surface of said depending walls generally opposite to the location of said first detent;

whereby when the pacifier shield is inserted in said cover, said detents engage the periphery of the shield and retain the shield firmly against said stops within said cover while said flange resiliently urges the shield against the opposite portion of said depending walls.

2. The cover of claim 1 wherein said stops are located at positions spaced from said detents.

3. The cover of claim 2 wherein each stop includes a stop shoulder extending inwardly of said cover and having a bottom surface adapted to engage the shield when received in said cover

4. The cover of claim 3 wherein said stop shoulders are elongated and each extend generally toward said top wall.

5. The cover of claim 2 including two pair of stops; one pair of stops spaced adjacent either side of said flange; the other pair of stops spaced adjacent either side of said second detent.

6. The cover of claim 1 including a second pair of spaced slots extending toward said top wall from said bottom edge and defining a second flange generally opposite to said first mentioned flange; said second detent position on said interior surface of said second flange.

7. The cover of claim 6 wherein said first and second detents each include curved surface means for camming said flanges outwardly to allow movement of the pacifier shield therepast upon insertion within said cover.

8. The cover of claim 7 wherein said curved surface means include protrusions which are spherical in shape.

9. The cover of claim 1 wherein said first and second detents include curved surfaces for camming said flange outwardly and facilitating movement of the pacifier shield past said detents upon insertion within said cover.

10. The cover of claim 1 wherein said cover has the general shape of a truncated pyramid, said depending walls flaring outwardly and downwardly from said top wall such that said opening is larger than said top wall.

11. The cover of claim 10 wherein said bottom edge of said opening is a continuous curve interrupted only by said slots and having an indentation on one portion generally intermediate said first and second detents.

12. The cover of claim 1 wherein each of said first and second detents has a pacifier shield engaging portion which is spaced closer to said top wall than at least one of said stops.

13. A removable cover for snap-in insertion, retention and protection of pacifiers of the type having a mouth shield and a nipple mounted on and extending outwardly from the shield, said cover comprising:

a top wall;

walls depending from said top wall defining an enclosure and having a bottom edge defining an opening to said enclosure for inserting a pacifier;

flange means on said depending walls for resiliently flexing and engaging a pacifier shield, said flange means being separated from portions of said depending walls by spaced slots;

a plurality of stop means on the interior of said depending walls for engaging the pacifier shield; and a pair of spaced detent means on said interior of said depending walls for engaging the pacifier shield and retaining the shield against said stop means within said cover, at least one of said detent means positioned on and movable with said flange means.

14. The cover of claim 13 wherein said stop means are located at positions spaced from said detents.

15. The cover of claim 14 wherein said stop means include two pair of stops; one pair of stops spaced adjacent either side of said flange means; the other pair of stops spaced adjacent either side of the other of said detent means.

16. The cover of claim 13 including second flange means on said depending walls and spaced from said first mentioned flange means for resiliently flexing and engaging a second portion of the pacifier shield when inserted in said cover, said second flange means being separated from other portions of said depending walls by a second set of spaced slots.

17. The cover of claim 16 wherein said first and second flange means each include a separate one of said detent means.

18. The cover of claim 17 wherein said detent means each include curved surfaces for camming said flange means outwardly and facilitating movement of the pacifier shield past said detent means upon insertion within said cover.

19. The cover of claim 14 wherein each of said detent means has a pacifier shield engaging portion which is spaced closer to said top wall than at least one of said stop means.

20. The cover of claim 14 wherein said cover has the general shape of a truncated pyramid, said depending walls flaring outwardly and downwardly from said top wall such that said opening is larger than said top wall.

* * * * *

UNITED STATES PATENT AND TRADEMARK OFFICE

CERTIFICATE OF CORRECTION

PATENT NO. : 4,946,054

DATED : August 7, 1990

INVENTOR(S) : Daniel A. Maniero et al.

It is certified that error appears in the above-identified patent and that said Letters Patent is hereby corrected as shown below:

Column 3, line 17:

"Walls" should be --walls--

Column 3, line 18:

"20 14" should be --14--

Column 3, line 49:

"83.5." should be --83.5°--

Column 3, line 51:

After "top" delete --20--

Column 4, line 9:

After "inserted" insert --.--

Column 4, line 21:

After "adhesive" insert --.--

Column 4, line 26:

"tho pacifier" should be --the pacifier--

Column 4, line 49:

After "The" delete --20--

UNITED STATES PATENT AND TRADEMARK OFFICE

CERTIFICATE OF CORRECTION

PATENT NO. : 4,946,054

DATED : August 7, 1990

INVENTOR(S) : Daniel A. Maniero et al.

It is certified that error appears in the above-identified patent and that said Letters Patent is hereby corrected as shown below:

Column 4, line 50

"conve" should be --convex--

Column 6, line 44

After "cover" insert --.--

Signed and Sealed this

Seventh Day of April, 1992

*Attest:*

HARRY F. MANBECK, JR.

*Attesting Officer*

*Commissioner of Patents and Trademarks*